US012722765B2

(12) United States Patent
Ikegaya

(10) Patent No.: US 12,722,765 B2
(45) Date of Patent: Sep. 1, 2026

(54) MARINE PROPULSION SYSTEM AND MARINE VESSEL

(71) Applicant: YAMAHA HATSUDOKI KABUSHIKI KAISHA, Iwata (JP)

(72) Inventor: Yuji Ikegaya, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 903 days.

(21) Appl. No.: 17/970,618

(22) Filed: Oct. 21, 2022

(65) Prior Publication Data

US 2023/0139789 A1 May 4, 2023

(30) Foreign Application Priority Data

Nov. 4, 2021 (JP) ..... 2021-180106

(51) Int. Cl.
*B63H 25/42* (2006.01)
*B63H 21/21* (2006.01)
*B63H 25/02* (2006.01)

(52) U.S. Cl.
CPC ..... *B63H 25/42* (2013.01); *B63H 21/21* (2013.01); *B63H 25/02* (2013.01); *B63H 2021/216* (2013.01); *B63H 2025/026* (2013.01)

(58) Field of Classification Search
CPC ..... B63H 25/02; B63H 25/42
See application file for complete search history.

(56) References Cited

U.S. PATENT DOCUMENTS

| | | | | |
|---|---|---|---|---|
| 4,573,930 | A * | 3/1986 | Queen | F16B 2/08 440/63 |
| 5,088,943 | A | 2/1992 | Henderson | |
| 2010/0151750 | A1* | 6/2010 | Ito | B63H 20/10 440/1 |
| 2014/0156124 | A1* | 6/2014 | Hara | B63H 25/02 701/21 |
| 2015/0166159 | A1* | 6/2015 | Inoue | B63H 20/12 440/53 |
| 2019/0179318 | A1* | 6/2019 | Miller | B63H 25/42 |
| 2019/0353093 | A1* | 11/2019 | Ito | B63H 20/12 |
| 2020/0172219 | A1 | 6/2020 | Schroeder | |
| 2021/0004007 | A1* | 1/2021 | Fujima | B63B 79/15 |
| 2023/0140720 | A1* | 5/2023 | Ikegaya | B63H 20/12 440/1 |

(Continued)

FOREIGN PATENT DOCUMENTS

| | | |
|---|---|---|
| JP | 2005-200004 A | 7/2005 |
| JP | 2014-080077 A | 5/2014 |

(Continued)

OTHER PUBLICATIONS

Official Communication issued in corresponding European Patent Application No. 22202502.5, mailed on Apr. 2, 2025, 9 pages.

(Continued)

*Primary Examiner* — Marc Q Jimenez
*Assistant Examiner* — Jovon E Hayes
(74) *Attorney, Agent, or Firm* — Keating & Bennett, LLP

(57) ABSTRACT

A marine propulsion system includes a controller configured or programmed to perform a control to move a hull in a lateral direction by driving both a main propulsion device and an auxiliary propulsion device having a maximum output smaller than a maximum output of the main propulsion device.

16 Claims, 4 Drawing Sheets

(56) References Cited

U.S. PATENT DOCUMENTS

| | | | | |
|---|---|---|---|---|
| 2024/0132194 | A1* | 4/2024 | Ikegaya | B63H 25/02 |
| 2024/0227998 | A9* | 7/2024 | Ikegaya | B63H 5/125 |

FOREIGN PATENT DOCUMENTS

| | | | | | |
|---|---|---|---|---|---|
| JP | 2015-116847 | A | | 6/2015 | |
| JP | 2019-199128 | A | | 11/2019 | |
| JP | 2020168921 | A | * | 10/2020 | B63H 5/125 |
| WO | 2019/180920 | A1 | | 9/2019 | |

OTHER PUBLICATIONS

Extended European Search Report in EP22202502.5, mailed Mar. 27, 2023, 8 pages.

* cited by examiner

MARINE PROPULSION SYSTEM AND MARINE VESSEL

CROSS REFERENCE TO RELATED APPLICATIONS

This application claims the benefit of priority to Japanese Patent Application No. 2021-180106 filed on Nov. 4, 2021. The entire contents of this application are hereby incorporated herein by reference.

BACKGROUND OF THE INVENTION

1. Field of the Invention

The present invention relates to a marine propulsion system and a marine vessel, and more particularly, it relates to a marine propulsion system and a marine vessel each including a main propulsion device and an auxiliary propulsion device with different maximum outputs.

2. Description of the Related Art

A marine vessel including a main propulsion device and an auxiliary propulsion device having different maximum outputs is known in general. Such a marine vessel is disclosed in Japanese Patent Laid-Open No. 2019-199128, for example.

Japanese Patent Laid-Open No. 2019-199128 discloses a marine vessel including a hull, a first outboard motor (main propulsion device) attached to the hull, a second outboard motor (auxiliary propulsion device) attached to the hull, and an operator to operate the first outboard motor and the second outboard motor. In the marine vessel described in Japanese Patent Laid-Open No. 2019-199128, the first outboard motor and the second outboard motor have different maximum outputs. Furthermore, in the marine vessel described in Japanese Patent Laid-Open No. 2019-199128, an operation switch is operated to switch between a state in which the first outboard motor is operated by the operator and a state in which the second outboard motor is operated by the operator. In other words, in the marine vessel described in Japanese Patent Laid-Open No. 2019-199128, the first outboard motor and the second outboard motor are not able to be driven simultaneously. In the marine vessel described in Japanese Patent Laid-Open No. 2019-199128, the number of first outboard motors and the number of second outboard motors may be one, or two or more.

Although not clearly described in Japanese Patent Laid-Open No. 2019-199128, in a conventional marine vessel as described in Japanese Patent Laid-Open No. 2019-199128, it is necessary to generate a resultant vector of output vectors of a plurality of outboard motors such that a hull moves in a lateral direction in order to move the hull in the lateral direction. In the marine vessel described in Japanese Patent Laid-Open No. 2019-199128, the first outboard motor (main propulsion device) and the second outboard motor (auxiliary propulsion device) are not able to be driven simultaneously, and thus it is necessary to provide at least one of a plurality of first outboard motors or a plurality of second outboard motors in order to move the hull in a lateral direction. Therefore, in a structure including a first outboard motor (main propulsion device) and a second outboard motor (auxiliary propulsion device) having different maximum outputs, it is desired to move a hull in a lateral direction while preventing an increase in the number of outboard motors (propulsion devices). In the field of marine vessels, from the viewpoint of SDGs (Sustainable Development Goals), it is desired to reduce environmental burdens, such as reducing the amount of carbon dioxide emissions associated with driving of propulsion devices.

SUMMARY OF THE INVENTION

Preferred embodiments of the present invention provide marine propulsion systems and marine vessels that each move hulls in a lateral direction while preventing an increase in the number of propulsion devices when including main propulsion devices and auxiliary propulsion devices having different maximum outputs.

A marine propulsion system according to a preferred embodiment of the present invention includes a main propulsion device attached to a stern of a hull and operable to rotate in a right-left direction to change a direction of a thrust, an auxiliary propulsion device attached to the stern, including an electric motor to drive an auxiliary thruster to generate a thrust, operable to rotate in the right-left direction to change a direction of the thrust, and having a maximum output smaller than a maximum output of the main propulsion device, and a controller configured or programmed to perform a control to move the hull in a lateral direction by driving both the main propulsion device and the auxiliary propulsion device.

In a marine propulsion system according to a preferred embodiment of the present invention, the controller is configured or programmed to perform a control to move the hull in the lateral direction by driving both the main propulsion device and the auxiliary propulsion device having a maximum output smaller than a maximum output of the main propulsion device. Accordingly, both the main propulsion device and the auxiliary propulsion device are driven such that a resultant vector of an output vector of the main propulsion device and an output vector of the auxiliary propulsion device is generated to move the hull in the lateral direction. Thus, the hull is moved in the lateral direction without providing either a plurality of main propulsion devices or a plurality of auxiliary propulsion devices. Consequently, in a structure including the main propulsion device and the auxiliary propulsion device having different maximum outputs, the hull is moved in the lateral direction while an increase in the number of propulsion devices is prevented.

In a marine propulsion system according to a preferred embodiment of the present invention, the auxiliary propulsion device used when the hull is moved in the lateral direction includes the electric motor to drive the auxiliary thruster to generate the thrust. Accordingly, unlike the engine, the electric motor does not directly emit carbon dioxide, and thus as compared with a case in which the auxiliary propulsion device including the electric motor is not used when the hull is moved in the lateral direction, from the viewpoint of SDGs, a preferable device structure is achieved.

In a marine propulsion system according to a preferred embodiment of the present invention, the main propulsion device is preferably provided on a centerline of the hull in the right-left direction, and the auxiliary propulsion device is preferably provided to one side of the centerline of the hull in the right-left direction. Accordingly, in a structure including the main propulsion device and the auxiliary propulsion device that have different maximum outputs and are asymmetrical to each other in the right-left direction of the hull, the hull is moved in the lateral direction while an increase in the number of propulsion devices is prevented.

In such a case, the controller is preferably configured or programmed to perform a control to move the hull in the lateral direction by positioning an intersection of an output vector of the main propulsion device and an output vector of the auxiliary propulsion device on a straight line extending from a center of gravity of the hull toward a side in the lateral direction in which the hull is to move. Accordingly, unlike a case in which the intersection of the output vector of the main propulsion device and the output vector of the auxiliary propulsion device is deviated from the straight line extending from the center of gravity of the hull toward a side in the lateral direction in which the hull is to move, a rotational moment is not generated in the hull, and thus the hull is moved in the lateral direction without being rotated. In this description, the term "rotate the hull" indicates changing the orientation of the bow while maintaining the position of the hull, unlike turning of the hull accompanied by forward or backward movement of the hull.

In a marine propulsion system including the controller configured or programmed to move the hull in the lateral direction by positioning the intersection of the output vector of the main propulsion device and the output vector of the auxiliary propulsion device on the straight line extending from the center of gravity of the hull toward a side in the lateral direction in which the hull is to move, the controller is preferably configured or programmed to perform a control to adjust, according to at least one of a shape of the hull, a size of the hull, and attachment positions of the main propulsion device and the auxiliary propulsion device to the hull, an output of the main propulsion device, a rudder angle of the main propulsion device, an output of the auxiliary propulsion device, and a rudder angle of the auxiliary propulsion device when both the main propulsion device and the auxiliary propulsion device are driven to move the hull in the lateral direction in response to an operation on an operator to move the hull in the lateral direction. Accordingly, the intersection of the output vector of the main propulsion device and the output vector of the auxiliary propulsion device is adjusted according to the shape and size of the hull, the attachment positions of the main propulsion device and the auxiliary propulsion device to the hull, etc. to be positioned on the straight line extending from the center of gravity of the hull toward a side in the lateral direction in which the hull is to move. That is, regardless of the shape and size of the hull, the attachment positions of the main propulsion device and the auxiliary propulsion device to the hull, etc., the hull is moved in the lateral direction without being rotated.

In a marine propulsion system including the main propulsion device provided on the centerline of the hull in the right-left direction and the auxiliary propulsion device provided to one side of the centerline of the hull in the right-left direction, the controller is preferably configured or programmed to perform a control to move the hull in a diagonal direction in addition to the control to move the hull in the lateral direction by driving both the main propulsion device and the auxiliary propulsion device. Accordingly, in a structure including the main propulsion device and the auxiliary propulsion device having different maximum outputs, the hull is moved in the diagonal direction in addition to the lateral direction while an increase in the number of propulsion devices is prevented.

In such a case, the controller is preferably configured or programmed to perform a control to move the hull in the diagonal direction by positioning an intersection of an output vector of the main propulsion device and an output vector of the auxiliary propulsion device on a straight line extending from a center of gravity of the hull toward a side in the diagonal direction in which the hull is to move. Accordingly, unlike a case in which the intersection of the output vector of the main propulsion device and the output vector of the auxiliary propulsion device is deviated from the straight line extending from the center of gravity of the hull toward a side in the diagonal direction in which the hull is to move, a rotational moment is not generated in the hull, and thus the hull is moved in the diagonal direction without being rotated.

In a marine propulsion system including the controller configured or programmed to move the hull in the diagonal direction by positioning the intersection of the output vector of the main propulsion device and the output vector of the auxiliary propulsion device on the straight line extending from the center of gravity of the hull toward a side in the diagonal direction in which the hull is to move, the controller is preferably configured or programmed to perform a control to adjust, according to at least one of a shape of the hull, a size of the hull, and attachment positions of the main propulsion device and the auxiliary propulsion device to the hull, an output of the main propulsion device, a rudder angle of the main propulsion device, an output of the auxiliary propulsion device, and a rudder angle of the auxiliary propulsion device when both the main propulsion device and the auxiliary propulsion device are driven to move the hull in the diagonal direction in response to an operation on an operator to move the hull in the diagonal direction. Accordingly, the intersection of the output vector of the main propulsion device and the output vector of the auxiliary propulsion device is adjusted according to the shape and size of the hull, the attachment positions of the main propulsion device and the auxiliary propulsion device to the hull, etc. to be positioned on the straight line extending from the center of gravity of the hull toward a side in the diagonal direction in which the hull is to move. That is, regardless of the shape and size of the hull, the attachment positions of the main propulsion device and the auxiliary propulsion device to the hull, etc., the hull is moved in the diagonal direction without being rotated.

In a marine propulsion system according to a preferred embodiment of the present invention, the main propulsion device preferably includes an engine having a maximum value and a minimum value of a power range larger than a maximum value and a minimum value of a power range of the electric motor to drive a main thruster to generate the thrust, and the controller is preferably configured or programmed to limit the power range of the engine by matching an upper limit value of the power range of the engine with the maximum value of the power range of the electric motor while both the main propulsion device and the auxiliary propulsion device are driven to move the hull in the lateral direction, and limit the power range of the electric motor by matching a lower limit value of the power range of the electric motor with the minimum value of the power range of the engine while both the main propulsion device and the auxiliary propulsion device are driven to move the hull in the lateral direction. Accordingly, the power range of the engine and the power range of the electric motor are limited within the same range while both the main propulsion device and the auxiliary propulsion device are driven to move the hull in the lateral direction, and thus when the hull is moved in the lateral direction, both the main propulsion device and the auxiliary propulsion device having different maximum outputs are easily driven.

In a marine propulsion system according to a preferred embodiment of the present invention, the controller is preferably configured or programmed to cause a direction of an output vector of the main propulsion device and a direction of an output vector of the auxiliary propulsion device to be opposite to each other in a forward-rearward direction when the hull is moved in the lateral direction. Accordingly, the forward-rearward component of the output vector of the main propulsion device and the forward-rearward component of the output vector of the auxiliary propulsion device cancel each other out, and thus the direction of the resultant vector of the output vector of the main propulsion device and the output vector of the auxiliary propulsion device is set to be lateral such that the hull is moved in the lateral direction.

In a marine propulsion system according to a preferred embodiment of the present invention, the controller is preferably configured or programmed to perform a control to move the hull in the lateral direction by driving both the main propulsion device and the auxiliary propulsion device when a joystick corresponding to an operator to operate the hull is tilted in the lateral direction. Accordingly, the direction (lateral direction) of an operation on the joystick (operator) and the direction (lateral direction) in which the hull is moved are the same as each other, and thus an operation on the joystick (operator) to move the hull in the lateral direction is performed in an intuitively easy-to-understand state.

In a marine propulsion system according to a preferred embodiment of the present invention, the main propulsion device is preferably an engine-type outboard motor including an engine to drive a main propeller corresponding to a main thruster that generates the thrust and provided on a centerline of the hull in the right-left direction, and the auxiliary propulsion device is preferably an electric outboard motor including the electric motor to drive an auxiliary propeller corresponding to the auxiliary thruster and provided to one side of the centerline of the hull in the right-left direction. The maximum value of the power range of the engine is generally larger than the maximum value of the power range of the electric motor. Therefore, as described above, the main propulsion device and the auxiliary propulsion device are an engine outboard motor and an electric outboard motor, respectively, such that a structure in which both the main propulsion device and the auxiliary propulsion device having a maximum output smaller than that of the main propulsion device are driven is easily achieved.

A marine propulsion system according to a preferred embodiment of the present invention includes a main propulsion device attached to a stern of a hull and operable to rotate in a right-left direction to change a direction of a thrust, an auxiliary propulsion device attached to the stern, operable to rotate in the right-left direction to change a direction of a thrust, and having a maximum output smaller than a maximum output of the main propulsion device, and a controller configured or programmed to perform a control to move the hull in a lateral direction by driving both the main propulsion device and the auxiliary propulsion device.

In a marine propulsion system according to a preferred embodiment of the present invention, the controller is configured or programmed to perform a control to move the hull in the lateral direction by driving both the main propulsion device and the auxiliary propulsion device having a maximum output smaller than a maximum output of the main propulsion device. Accordingly, similarly to the marine propulsion systems according to preferred embodiments of the present invention described above, in a structure including the main propulsion device and the auxiliary propulsion device having different maximum outputs, the hull is moved in the lateral direction while an increase in the number of propulsion devices is prevented.

A marine vessel according to a preferred embodiment of the present invention includes a hull, and a marine propulsion system provided on or in the hull. The marine propulsion system includes a main propulsion device attached to a stern of the hull and operable to rotate in a right-left direction to change a direction of a thrust, an auxiliary propulsion device attached to the stern, including an electric motor to drive an auxiliary thruster to generate a thrust, operable to rotate in the right-left direction to change a direction of the thrust, and having a maximum output smaller than a maximum output of the main propulsion device, and a controller configured or programmed to perform a control to move the hull in a lateral direction by driving both the main propulsion device and the auxiliary propulsion device.

In a marine vessel according to a preferred embodiment of the present invention, the controller is configured or programmed to perform a control to move the hull in the lateral direction by driving both the main propulsion device and the auxiliary propulsion device having a maximum output smaller than a maximum output of the main propulsion device. Accordingly, similarly to the marine propulsion systems according to preferred embodiments of the present invention described above, in a structure including the main propulsion device and the auxiliary propulsion device having different maximum outputs, the hull is moved in the lateral direction while an increase in the number of propulsion devices is prevented.

In a marine vessel according to a preferred embodiment of the present invention, the auxiliary propulsion device used when the hull is moved in the lateral direction includes the electric motor to drive the auxiliary thruster to generate the thrust. Accordingly, similarly to the marine propulsion systems according to preferred embodiments of the present invention described above, as compared with a case in which the auxiliary propulsion device including the electric motor is not used when the hull is moved in the lateral direction, from the viewpoint of SDGs, a preferable device structure is achieved.

In a marine vessel according to a preferred embodiment of the present invention, the main propulsion device is preferably provided on a centerline of the hull in the right-left direction, and the auxiliary propulsion device is preferably provided to one side of the centerline of the hull in the right-left direction. Accordingly, similarly to the marine propulsion systems according to preferred embodiments of the present invention described above, in a structure including the main propulsion device and the auxiliary propulsion device that have different maximum outputs and are asymmetrical to each other in the right-left direction of the hull, the hull is moved in the lateral direction while an increase in the number of propulsion devices is prevented.

In such a case, the controller is preferably configured or programmed to perform a control to move the hull in the lateral direction by positioning an intersection of an output vector of the main propulsion device and an output vector of the auxiliary propulsion device on a straight line extending from a center of gravity of the hull toward a side in the lateral direction in which the hull is to move. Accordingly, similarly to the marine propulsion systems according to preferred embodiments of the present invention described above, the hull is moved in the lateral direction without being rotated.

In a marine vessel including the controller configured or programmed to move the hull in the lateral direction by positioning the intersection of the output vector of the main propulsion device and the output vector of the auxiliary propulsion device on the straight line extending from the center of gravity of the hull toward a side in the lateral direction in which the hull is to move, the controller is preferably configured or programmed to perform a control to adjust, according to at least one of a shape of the hull, a size of the hull, and attachment positions of the main propulsion device and the auxiliary propulsion device to the hull, an output of the main propulsion device, a rudder angle of the main propulsion device, an output of the auxiliary propulsion device, and a rudder angle of the auxiliary propulsion device when both the main propulsion device and the auxiliary propulsion device are driven to move the hull in the lateral direction in response to an operation on an operator to move the hull in the lateral direction. Accordingly, similarly to the marine propulsion systems according to preferred embodiments of the present invention described above, regardless of the shape and size of the hull, the attachment positions of the main propulsion device and the auxiliary propulsion device to the hull, etc., the hull is moved in the lateral direction without being rotated.

In a marine vessel including the main propulsion device provided on the centerline of the hull in the right-left direction and the auxiliary propulsion device provided to one side of the centerline of the hull in the right-left direction, the controller is preferably configured or programmed to perform a control to move the hull in a diagonal direction in addition to the control to move the hull in the lateral direction by driving both the main propulsion device and the auxiliary propulsion device. Accordingly, similarly to the marine propulsion systems according to preferred embodiments of the present invention described above, in a structure including the main propulsion device and the auxiliary propulsion device having different maximum outputs, the hull is moved in the diagonal direction in addition to the lateral direction while an increase in the number of propulsion devices is prevented.

In such a case, the controller is preferably configured or programmed to perform a control to move the hull in the diagonal direction by positioning an intersection of an output vector of the main propulsion device and an output vector of the auxiliary propulsion device on a straight line extending from a center of gravity of the hull toward a side in the diagonal direction in which the hull is to move. Accordingly, similarly to the marine propulsion systems according to preferred embodiments of the present invention described above, the hull is moved in the diagonal direction without being rotated.

In a marine vessel including the controller configured or programmed to move the hull in the diagonal direction by positioning the intersection of the output vector of the main propulsion device and the output vector of the auxiliary propulsion device on the straight line extending from the center of gravity of the hull toward a side in the diagonal direction in which the hull is to move, the controller is preferably configured or programmed to perform a control to adjust, according to at least one of a shape of the hull, a size of the hull, and attachment positions of the main propulsion device and the auxiliary propulsion device to the hull, an output of the main propulsion device, a rudder angle of the main propulsion device, an output of the auxiliary propulsion device, and a rudder angle of the auxiliary propulsion device when both the main propulsion device and the auxiliary propulsion device are driven to move the hull in the diagonal direction in response to an operation on an operator to move the hull in the diagonal direction. Accordingly, similarly to the marine propulsion systems according to preferred embodiments of the present invention described above, regardless of the shape and size of the hull, the attachment positions of the main propulsion device and the auxiliary propulsion device to the hull, etc., the hull is moved in the diagonal direction without being rotated.

In a marine vessel according to a preferred embodiment of the present invention, the main propulsion device preferably includes an engine having a maximum value and a minimum value of a power range larger than a maximum value and a minimum value of a power range of the electric motor to drive a main thruster to generate the thrust, and the controller is preferably configured or programmed to limit the power range of the engine by matching an upper limit value of the power range of the engine with the maximum value of the power range of the electric motor while both the main propulsion device and the auxiliary propulsion device are driven to move the hull in the lateral direction, and limit the power range of the electric motor by matching a lower limit value of the power range of the electric motor with the minimum value of the power range of the engine while both the main propulsion device and the auxiliary propulsion device are driven to move the hull in the lateral direction. Accordingly, similarly to the marine propulsion systems according to preferred embodiments of the present invention described above, when the hull is moved in the lateral direction, both the main propulsion device and the auxiliary propulsion device having different maximum outputs are easily driven.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

The structures of a marine propulsion system 100 and a marine vessel 110 according to preferred embodiments of the present invention are now described with reference to FIGS. 1 to 8. In the figures, arrow FWD represents the front of the marine vessel 110, arrow BWD represents the rear of the marine vessel 110, arrow L represents the left (port side) of the marine vessel 110, and arrow R represents the right (starboard side) of the marine vessel 110.

Figure 1:
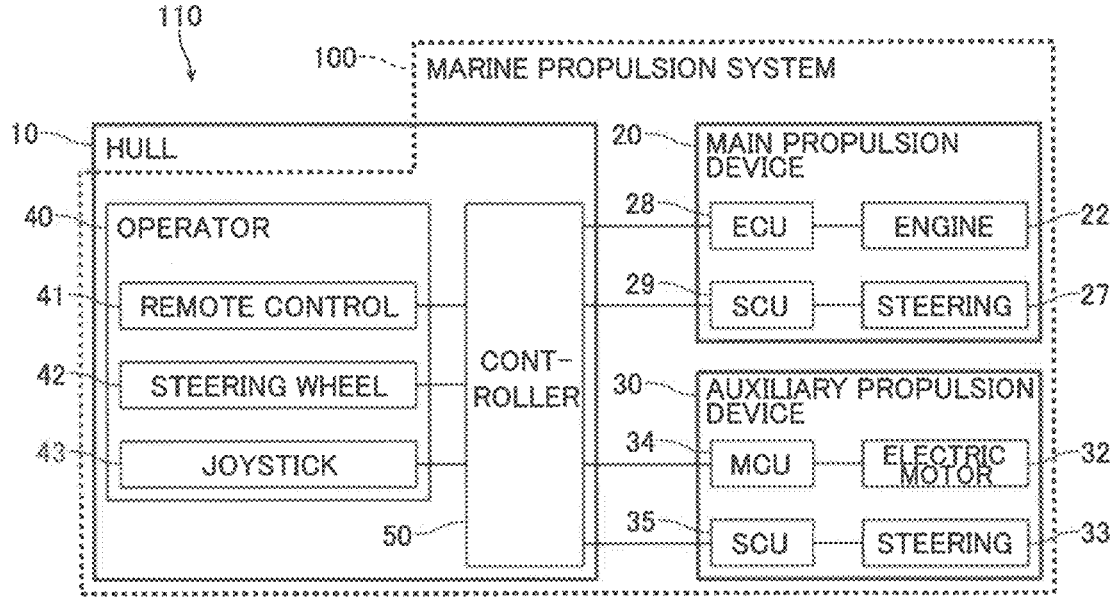
FIG. 1 is a block diagram showing a marine propulsion system according to a preferred embodiment of the present invention.

As shown in FIG. 1, the marine vessel 110 includes a hull 10 and the marine propulsion system 100. The marine propulsion system 100 is provided on or in the hull 10. The marine propulsion system 100 propels the marine vessel 110. The marine vessel 110 may be a relatively small marine vessel used for sightseeing or fishing, for example.

The marine propulsion system 100 includes a main propulsion device 20, an auxiliary propulsion device 30, an operator 40, and a controller 50. The operator 40 and the controller 50 are provided on and in the hull 10.

Figure 2:
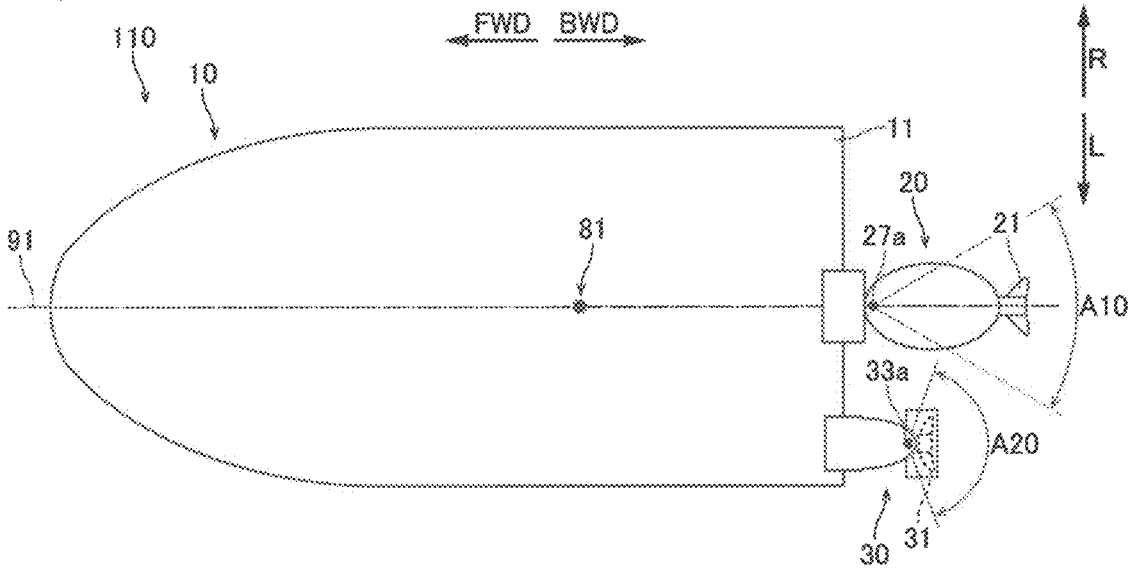
FIG. 2 is a schematic view showing a marine vessel according to a preferred embodiment of the present invention.

As shown in FIG. 2, only one main propulsion device 20 is attached to a stern 11 of the hull 10. The main propulsion device 20 is located on a centerline 91 of the hull 10 in a right-left direction.

Figure 3:
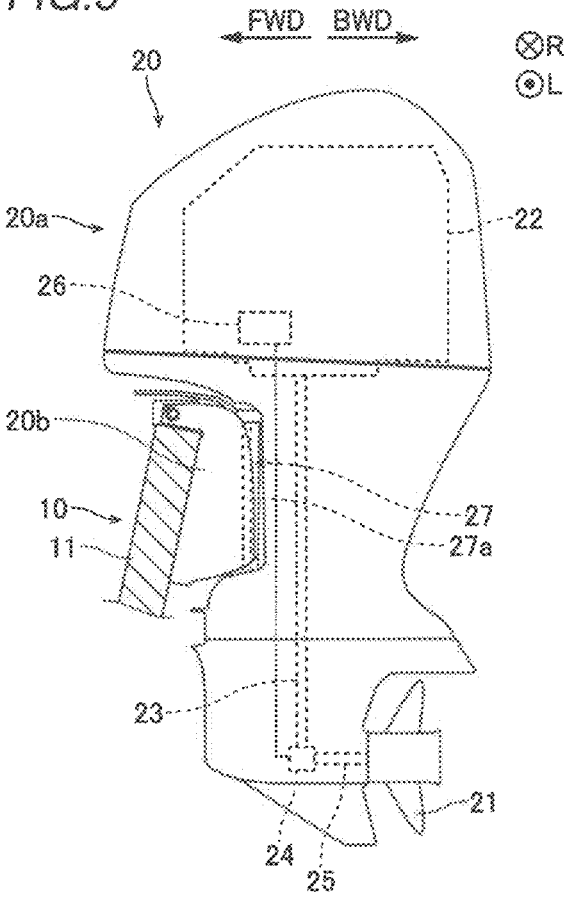
FIG. 3 is a side view showing a main propulsion device of a marine vessel according to a preferred embodiment of the present invention.

As shown in FIG. 3, the main propulsion device 20 includes a main propulsion device main body 20*a* and a bracket 20*b*. The main propulsion device main body 20*a* is attached to the stern 11 of the hull 10 via the bracket 20*b*.

The main propulsion device 20 is an engine outboard motor including an engine 22 to drive a main propeller 21 that generates a thrust. Specifically, the main propulsion device main body 20*a* includes the engine 22, a drive shaft 23, a gearing 24, a propeller shaft 25, and the main propeller 21. The engine 22 is an internal combustion engine that generates a driving force. The driving force of the engine 22 is transmitted to the main propeller 21 via the drive shaft 23, the gearing 24, and the propeller shaft 25. The main propeller 21 generates a thrust by rotating in the water by the driving force transmitted from the engine 22. The main propeller 21 is an example of a "main thruster".

The main propulsion device main body 20*a* includes a shift actuator 26 that switches the shift state of the main propulsion device 20. The shift actuator 26 switches the shift state of the main propulsion device 20 between a forward movement state, a backward movement state, and a neutral state by switching the meshing of the gearing 24. In the forward movement state, a driving force is transmitted from the engine 22 to the main propeller 21 to generate a forward thrust from the main propeller 21. In the backward movement state, a driving force is transmitted from the engine 22 to the main propeller 21 to generate a backward thrust from the main propeller 21. In the neutral state, a driving force is not transmitted from the engine 22 to the main propeller 21 in order to not generate a thrust in the main propeller 21. In the main propulsion device 20, when the shift state of the main propulsion device 20 is switched, the gearing 24 generates relatively loud noises and vibrations.

The main propulsion device 20 rotates in the right-left direction to change the direction of a thrust. Specifically, a steering 27 is provided on the bracket 20*b*. The steering 27 includes a steering shaft 27*a* that extends in an upward-downward direction. The main propulsion device main body 20*a* is rotated in the right-left direction by the steering 27 about the steering shaft 27*a* with respect to the bracket 20*b*. When the main propulsion device main body 20*a* rotates in the right-left direction about the steering shaft 27*a*, the orientation of the main propeller 21 also rotates in the right-left direction. Thus, the direction of the thrust of the main propeller 21 is changed. In the following description, changing the direction of the thrust of the main propeller 21 by rotating the orientation of the main propeller 21 in the right-left direction is referred to as "steering the main propulsion device 20".

As shown in FIG. 2, the main propulsion device 20 is steerable by about 30 degrees to each of the L side and the R side. That is, a steering angular range A10, which is an angular range in which the main propulsion device 20 is steerable, is about 60 degrees.

As shown in FIG. 1, the main propulsion device 20 includes an engine control unit (ECU) 28 and a steering control unit (SCU) 29. The ECU 28 controls driving of the engine 22 and driving of the shift actuator 26 based on control by the controller 50. The SCU 29 controls driving of the steering 27 based on control by the controller 50. The ECU 28 and the SCU 29 include a control circuit including a central processing unit (CPU), for example.

As shown in FIG. 2, only one auxiliary propulsion device 30 is attached to the stern 11 of the hull 10. The auxiliary propulsion device 30 is provided to one side of the centerline of the hull 10 in the right-left direction. In the marine propulsion system 100, the auxiliary propulsion device 30 is provided to the L side of the hull 10.

Figure 4:
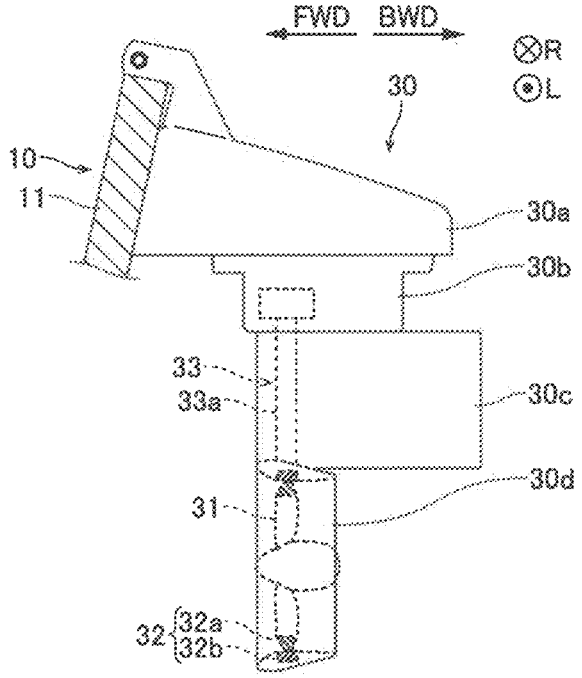
FIG. 4 is a side view showing an auxiliary propulsion device of a marine vessel according to a preferred embodiment of the present invention.

As shown in FIG. 4, the auxiliary propulsion device 30 includes a cowling 30*a*, an upper case 30*b*, a lower case 30*c*, and a duct 30*d*. The cowling 30*a*, the upper case 30*b*, the lower case 30*c*, and the duct 30*d* are aligned in this order from top to bottom. The cowling 30*a* is attached to the stern 11 of the hull 10.

The auxiliary propulsion device 30 is an electric outboard motor including an electric motor 32 to drive an auxiliary propeller 31 that generates a thrust. Specifically, the auxiliary propulsion device 30 includes the electric motor 32 and the auxiliary propeller 31. The electric motor 32 is provided in the duct 30*d*. The auxiliary propeller 31 is provided in the duct 30*d*. The electric motor 32 is driven by power from a battery (not shown) provided in the hull 10. The electric motor 32 includes a stator 32*a* that is integral and unitary with the duct 30*d*, and a rotor 32*b* that is integral and unitary with the auxiliary propeller 31. The auxiliary propeller 31 generates a thrust by rotating in the water by a driving force transmitted from the electric motor 32. The auxiliary propeller 31 is an example of an "auxiliary thruster".

When the auxiliary propeller 31 is rotated forward, a forward thrust is generated from the auxiliary propeller 31. When the auxiliary propeller 31 is rotated backward, a backward thrust is generated from the auxiliary propeller 31. When the auxiliary propeller 31 is stopped, a thrust is not generated from the auxiliary propeller 31. That is, in the auxiliary propulsion device 30, it is not necessary to switch the meshing of the gearing 24 (see FIG. 3) unlike the main propeller 21 (see FIG. 3) of the main propulsion device 20 (see FIG. 3). Thus, the auxiliary propulsion device 30 does not generate relatively loud noises or vibrations unlike the main propulsion device 20.

The auxiliary propulsion device 30 rotates in the right-left direction to change the direction of a thrust. Specifically, a steering 33 is provided in the auxiliary propulsion device 30. The steering 33 includes a steering shaft 33*a* fixed to the lower case 30*c* and extending in the upward-downward direction. An upper end of the steering shaft 33*a* is located in the upper case 30*b*. A lower end of the steering shaft 33*a* is fixed to the duct 30*d*. The duct 30*d* and the lower case 30*c* are rotatable in the right-left direction by the steering 33 about the steering shaft 33*a* with respect to the cowling 30*a* and the upper case 30*b*. When the duct 30*d* rotates in the right-left direction about the steering shaft 33*a*, the orientation of the auxiliary propeller 31 also rotates in the right-left direction. Thus, the direction of the thrust of the auxiliary propeller 31 is changed. In the following description, changing the direction of the thrust of the auxiliary propeller 31 by rotating the orientation of the auxiliary propeller 31 in the right-left direction is referred to as "steering the auxiliary propulsion device 30".

As shown in FIG. 2, the auxiliary propulsion device 30 is steerable by about 70 degrees to each of the L side and the R side. That is, a steering angular range A20, which is an angular range in which the auxiliary propulsion device 30 is steerable, is about 140 degrees.

As shown in FIG. 1, the auxiliary propulsion device 30 includes a motor control unit (MCU) 34 and a steering control unit (SCU) 35. The MCU 34 and the SCU 35 include a control circuit including a CPU, for example. The MCU 34 controls driving of the electric motor 32 based on control by the controller 50. The SCU 35 controls driving of the steering 33 based on control by the controller 50.

Figure 5:
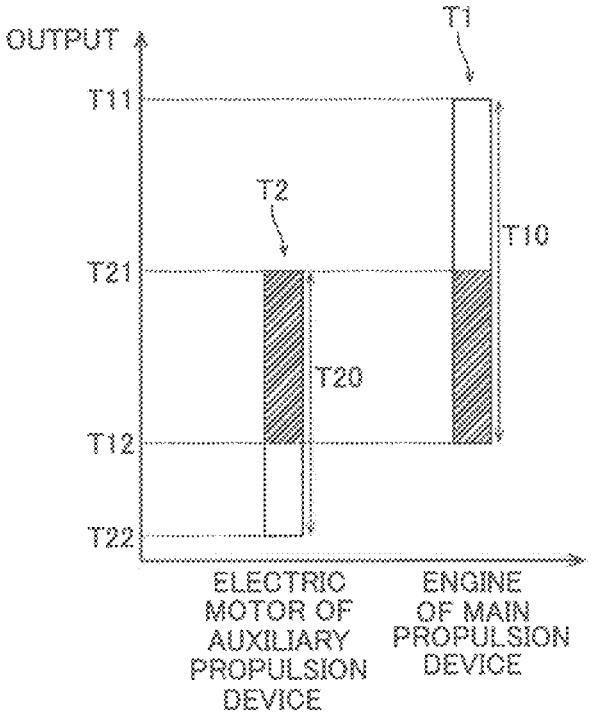
FIG. 5 is a diagram showing the power range of an engine of a main propulsion device and the power range of an electric motor of an auxiliary propulsion device according to a preferred embodiment of the present invention.

As shown in FIG. 5, the maximum output of the auxiliary propulsion device 30 is smaller than that of the main propulsion device 20. Specifically, the maximum value T11 and the minimum value T12 of the power range T10 of the engine 22 of the main propulsion device 20 are larger than the maximum value T21 and the minimum value T22 of the power range T20 of the electric motor 32 of the auxiliary propulsion device 30, respectively. The minimum value T12 of the power range T10 of the engine 22 is smaller than the maximum value T21 of the power range T20 of the electric motor 32. That is, the power range T10 of the engine 22 of the main propulsion device 20 and the power range T20 of the electric motor 32 of the auxiliary propulsion device 30 overlap each other between the maximum value T21 of the power range T20 of the electric motor 32 and the minimum value T12 of the power range T10 of the engine 22.

As shown in FIG. 1, the operator 40 receives a user's operation in order to operate (maneuver) the hull 10. The operator 40 includes a remote control 41, a steering wheel 42, and a joystick 43. The joystick 43 is an example of an "operator".

The remote control 41 includes a lever. The steering wheel 42 is rotatable. The hull 10 is operated by combining an operation on the lever of the remote control 41 and an operation to rotate the steering wheel 42.

Figure 6:
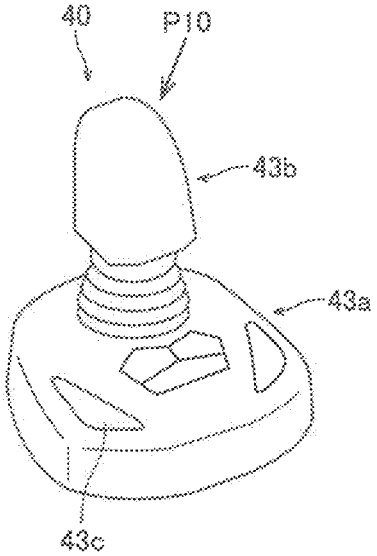
FIG. 6 is a diagram showing a joystick of a marine vessel according to a preferred embodiment of the present invention.

As shown in FIG. 6, the joystick 43 includes a base 43*a* and a lever 43*b*. The lever 43*b* is tiltably and rotatably attached to the base 43*a*. The lever 43*b* is urged by an urging member such as a spring to automatically return to a neutral position P10 when not operated by the user. At the neutral position P10, the lever 43*b* is upright and is not rotated.

Operations on the joystick 43 are roughly divided into three operations: an operation to tilt the lever 43*b*, an operation to tilt and rotate the lever 43*b*, and an operation to rotate the lever 43*b*. The operation to tilt the lever 43*b* corresponds to an operation to translate the hull 10 (see FIG. 1). The translation includes forward and backward movements, lateral movements, and diagonal movements. The operation to tilt and rotate the lever 43*b* corresponds to an operation to turn the hull 10. The turning includes clockwise turning and counterclockwise turning. The operation to rotate the lever 43*b* corresponds to an operation to rotate the hull 10. In the following description, for convenience of explanation, "tilting the lever 43*b*" is referred to as "tilting the joystick 43".

A joystick mode switch 43*c* is provided on the base 43*a* of the joystick 43. In the marine propulsion system 100, the joystick mode switch 43*c* is pressed to switch between a state in which the controller 50 controls driving of the main propulsion device 20 and driving of the auxiliary propulsion device 30 based on an operation on the joystick 43 (joystick mode) and a state in which the controller 50 controls driving of the main propulsion device 20 and driving of the auxiliary propulsion device 30 based on operations on the remote control 41 and the steering wheel 42 (non-joystick mode). When the marine propulsion system 100 is in the joystick mode, operations on the remote control 41 and the steering wheel 42 are not received. When the marine propulsion system 100 is in the non-joystick mode, an operation on the joystick 43 is not received.

As shown in FIG. 1, the controller 50 controls the ECU 28 of the main propulsion device 20, the SCU 29 of the main propulsion device 20, the MCU 34 of the auxiliary propulsion device 30, and the SCU 29 of the auxiliary propulsion device 30 based on an operation on the operator 40. The controller 50 includes a control circuit including a CPU, for example.

Figure 7:
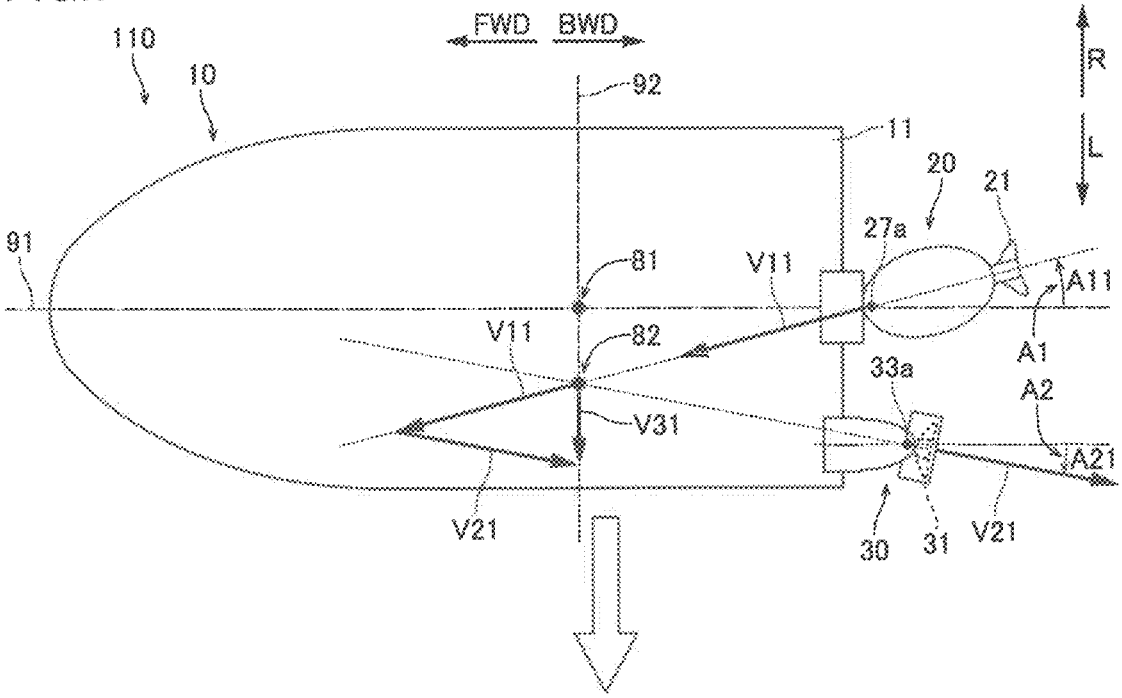
FIG. 7 is a schematic view showing lateral movement of a hull of a marine vessel according to a preferred embodiment of the present invention.
Figure 8:
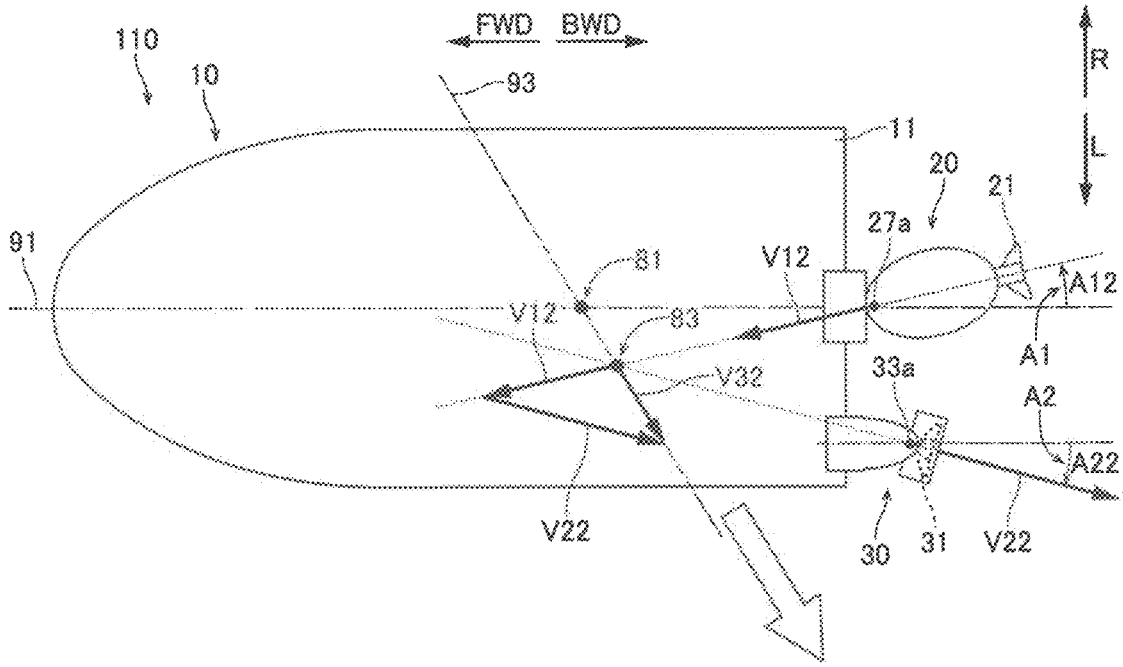
FIG. 8 is a schematic view showing diagonal movement of a hull of a marine vessel according to a preferred embodiment of the present invention.

As shown in FIGS. 7 and 8, the controller 50 (see FIG. 1) performs a control to move the hull 10 in a lateral direction and in a diagonal direction by driving both the main propulsion device 20 and the auxiliary propulsion device 30. When the joystick 43 is tilted in the lateral direction and the diagonal direction, the controller 50 performs a control to move the hull 10 in the lateral direction and the diagonal direction, respectively, by driving both the main propulsion device 20 and the auxiliary propulsion device 30.

As shown in FIG. 5, the controller 50 (see FIG. 1) limits the power range T10 of the engine 22 by matching the upper limit value of the power range T10 of the engine 22 with the maximum value T21 of the power range T20 of the electric motor 32 while both the main propulsion device 20 and the auxiliary propulsion device 30 are driven to move the hull 10 (see FIG. 1) in the lateral and diagonal directions, and limits the power range T20 of the electric motor 32 by matching the lower limit value of the power range T20 of the electric motor 32 with the minimum value T12 of the power range T10 of the engine 22 while both the main propulsion device 20 and the auxiliary propulsion device 30 are driven to move the hull 10 in the lateral and diagonal directions. Specifically, the controller 50 performs a control to limit each of the power range T10 of the engine 22 and the power range T20 of the electric motor 32 to a range in which the power range T10 of the engine 22 and the power range T20 of the electric motor 32 overlap each other (between the maximum value T21 of the power range T20 of the electric motor 32 and the minimum value T12 of the power range T10 of the engine 22) when both the main propulsion device 20 and the auxiliary propulsion device 30 are driven to move the hull 10 in the lateral direction and the diagonal direction.

As shown in FIG. 7, the controller 50 (see FIG. 1) performs a control to move the hull 10 in the lateral direction by positioning an intersection 82 of an output vector V11 of the main propulsion device 20 and an output vector V21 of the auxiliary propulsion device 30 on a straight line 92 extending from the center of gravity 81 of the hull 10 toward a side in the lateral direction in which the hull 10 is to move. Specifically, the controller 50 (see FIG. 1) controls the output T1 (see FIG. 5) of the main propulsion device 20, the rudder angle A1 of the main propulsion device 20, the output T2 (see FIG. 5) of the auxiliary propulsion device 30, and the rudder angle A2 of the auxiliary propulsion device 30 such that the direction of a resultant vector V31 of the output vector V11 of the main propulsion device 20 and the output vector V21 of the auxiliary propulsion device 30 becomes a direction (lateral direction) in which the joystick 43 is tilted, and the magnitude of the resultant vector V31 becomes a magnitude corresponding to the amount of tilting of the joystick 43 when the marine propulsion system 100 is in the joystick mode and the joystick 43 (see FIG. 1) is tilted in the lateral direction. Furthermore, the controller 50 controls the output T1 of the main propulsion device 20, the rudder angle A1 of the main propulsion device 20, the output T2 of the auxiliary propulsion device 30, and the rudder angle A2 of the auxiliary propulsion device 30 such that the intersection 82 of the output vector V11 of the main propulsion device 20 and the output vector V21 of the auxiliary propulsion device 30 is positioned on the straight line 92 extending from the center of gravity 81 of the hull 10 toward a side in the lateral direction in which the hull 10 is to move. FIG. 7 shows an example in which the joystick 43 is tilted to the left and the marine vessel 110 is moved to the L side. Furthermore, FIG. 7 shows an example in which the rudder angle A1 of the main propulsion device 20 and the rudder angle A2 of the auxiliary propulsion device 30 are A11 and A21, respectively.

The output T1 (see FIG. 5) of the main propulsion device 20, the rudder angle A1 of the main propulsion device 20, the output T2 (see FIG. 5) of the auxiliary propulsion device 30, and the rudder angle A2 of the auxiliary propulsion device 30, at which the intersection 82 of the output vector V11 of the main propulsion device 20 and the output vector V21 of the auxiliary propulsion device 30 is positioned on the straight line 92 extending from the center of gravity 81 of the hull 10 toward a side in the lateral direction in which the hull 10 is to move, differ depending on the shape and size of the hull 10, the attachment positions of the main propulsion device 20 and the auxiliary propulsion device 30 to the hull 10, etc. Therefore, the controller 50 (see FIG. 1) performs a control (calibration control) to adjust, according to at least one of a shape of the hull 10, a size of the hull 10, and attachment positions of the main propulsion device 20 and the auxiliary propulsion device 30 to the hull 10, the output T1 of the main propulsion device 20, the rudder angle A1 of the main propulsion device 20, the output T2 of the auxiliary propulsion device 30, and the rudder angle A2 of the auxiliary propulsion device 30 when both the main propulsion device 20 and the auxiliary propulsion device 30 are driven to move the hull 10 in the lateral direction in response to an operation on the joystick 43 (see FIG. 1) to move the hull 10 in the lateral direction.

Specifically, in the marine vessel 110 in which the calibration control is not performed, a vessel operator tilts the joystick 43 (see FIG. 1) such that the hull 10 moves in the lateral direction. At this time, the tilting direction of the joystick 43 is deviated from the lateral direction. That is, in the marine vessel 110 in which the calibration control is not performed, the tilting direction of the joystick 43 and the moving direction of the hull 10 do not match. Then, while tilting the joystick 43 to move the hull 10 in the lateral direction, the vessel operator performs an operation (pressing a calibration button, for example) to memorize the tilting direction of the joystick in which the hull 10 moves in the lateral direction. After that, when the joystick 43 is tilted in the lateral direction, the controller 50 (see FIG. 1) controls the main propulsion device 20 and the auxiliary propulsion device 30 to move the hull 10 in the lateral direction. The calibration control may be performed at the time of the initial operation of the marine propulsion system 100, or after the attachment positions of the main propulsion device 20 and the auxiliary propulsion device 30 to the hull 10 are changed, for example.

When both the main propulsion device 20 and the auxiliary propulsion device 30 attached to the stern 11 of the hull 10 are driven to move the hull 10 in the lateral direction, a forward-rearward component of the output vector V11 of the main propulsion device 20 and a forward-rearward component of the output vector V21 of the auxiliary propulsion device 30 are opposite to each other in a forward-rearward direction. That is, when the hull 10 is moved in the lateral direction, the controller 50 (see FIG. 1) causes the direction of the output vector V11 of the main propulsion device 20 and the direction of the output vector V21 of the auxiliary propulsion device 30 to be opposite to each other in the forward-rearward direction.

As shown in FIG. 8, the controller 50 (see FIG. 1) performs a control to move the hull 10 in the diagonal direction by driving both the main propulsion device 20 and the auxiliary propulsion device 30. Specifically, the controller 50 moves the hull 10 in the diagonal direction by positioning an intersection 83 of an output vector V12 of the main propulsion device 20 and an output vector V22 of the auxiliary propulsion device 30 on a straight line 93 extending from the center of gravity 81 of the hull 10 toward one side in the diagonal direction that is to be the moving direction of the hull 10. Furthermore, the controller 50 performs a control to move the hull 10 in the diagonal direction by driving both the main propulsion device 20 and the auxiliary propulsion device 30 when the joystick 43 is tilted in the diagonal direction.

Specifically, when the vessel propulsion system 100 is in the joystick mode and the joystick 43 (see FIG. 1) is tilted in the diagonal direction, the controller 50 (see FIG. 1) controls the output T1 (see FIG. 5) of the main propulsion device 20, the rudder angle A1 of the main propulsion device 20, the output T2 (see FIG. 5) of the auxiliary propulsion device 30, and the rudder angle A2 of the auxiliary propulsion device 30 such that the direction of a resultant vector V32 of the output vector V12 of the main propulsion device 20 and the output vector V22 of the auxiliary propulsion device 30 becomes a direction (diagonal direction) in which the joystick 43 is tilted, and the magnitude of the resultant vector V32 becomes a magnitude corresponding to the amount of tilting of the joystick 43. Furthermore, the controller 50 controls the output T1 of the main propulsion device 20, the rudder angle A1 of the main propulsion device 20, the output T2 of the auxiliary propulsion device 30, and the rudder angle A2 of the auxiliary propulsion device 30 such that the intersection 83 of the output vector V12 of the main propulsion device 20 and the output vector V22 of the auxiliary propulsion device 30 is positioned on the straight line 93 extending from the center of gravity 81 of the hull 10 toward one side in the diagonal direction that is to be the moving direction of the hull 10. FIG. 8 shows an example in which the joystick 43 is tilted to the left rear to move the marine vessel 110 to the L side and the BWD side. Furthermore, FIG. 8 shows an example in which the rudder angle A1 of the main propulsion device 20 and the rudder angle A2 of the auxiliary propulsion device 30 are A12 and A22, respectively. A12 may be equal to or different from A11. A22 may be equal to or different from A21.

The controller 50 performs a control (calibration control) to adjust, according to the hull 10, the output T1 (see FIG. 5) of the main propulsion device 20, the rudder angle A1 of the main propulsion device 20, the output T2 (see FIG. 5) of the auxiliary propulsion device 30, and the rudder angle A2 of the auxiliary propulsion device 30 when both the main propulsion device 20 and the auxiliary propulsion device 30 are driven to move the hull 10 in the diagonal direction in response to an operation on the joystick 43 to move the hull 10 in the diagonal direction, similarly to the control to move the hull 10 in the lateral direction.

According to the various preferred embodiments of the present invention described above, the following advantageous effects are achieved.

According to a preferred embodiment of the present invention, the controller 50 is configured or programmed to perform a control to move the hull 10 in the lateral direction by driving both the main propulsion device 20 and the auxiliary propulsion device 30 having a maximum output smaller than a maximum output of the main propulsion device 20. Accordingly, both the main propulsion device 20 and the auxiliary propulsion device 30 are driven such that the resultant vector V31 of the output vector V11 of the main propulsion device 20 and the output vector V21 of the auxiliary propulsion device 30 is generated to move the hull 10 in the lateral direction. Thus, the hull 10 is moved in the lateral direction without providing either a plurality of main propulsion devices 20 or a plurality of auxiliary propulsion devices 30. Consequently, in a structure including the main propulsion device 20 and the auxiliary propulsion device 30 having different maximum outputs, the hull 10 is moved in the lateral direction while an increase in the number of propulsion devices is prevented.

According to a preferred embodiment of the present invention, the auxiliary propulsion device 30 used when the hull 10 is moved in the lateral direction includes the electric motor 32 to drive the auxiliary propeller 31 (auxiliary thruster) that generates a thrust. Accordingly, unlike the engine 22, the electric motor 32 does not directly emit carbon dioxide, and thus as compared with a case in which the auxiliary propulsion device 30 including the electric motor 32 is not used when the hull 10 is moved in the lateral direction, from the viewpoint of SDGs, a preferable device structure is achieved.

According to a preferred embodiment of the present invention, the main propulsion device 20 is provided on the centerline 91 of the hull 10 in the right-left direction, and the auxiliary propulsion device 30 is provided to one side of the centerline of the hull 10 in the right-left direction. Accordingly, in a structure including the main propulsion device 20 and the auxiliary propulsion device 30 that have different maximum outputs and are asymmetrical to each other in the right-left direction of the hull 10, the hull 10 is moved in the lateral direction while an increase in the number of propulsion devices is prevented.

According to a preferred embodiment of the present invention, the controller 50 is configured or programmed to perform a control to move the hull 10 in the lateral direction by positioning the intersection 82 of the output vector V11 of the main propulsion device 20 and the output vector V21 of the auxiliary propulsion device 30 on the straight line 92 extending from the center of gravity 81 of the hull 10 toward one side in the lateral direction that is to be the moving direction of the hull 10. Accordingly, unlike a case in which the intersection 82 of the output vector V11 of the main propulsion device 20 and the output vector V21 of the auxiliary propulsion device 30 is deviated from the straight line 92 extending from the center of gravity 81 of the hull 10 toward one side in the lateral direction that is to be the moving direction of the hull 10, a rotational moment is not generated in the hull 10, and thus the hull 10 is moved in the lateral direction without being rotated.

According to a preferred embodiment of the present invention, the controller 50 is configured or programmed to perform a control to adjust, according to at least one of a shape of the hull 10, a size of the hull 10, and attachment positions of the main propulsion device 20 and the auxiliary propulsion device 30 to the hull 10, the output T1 of the main propulsion device 20, the rudder angle A1 of the main propulsion device 20, the output T2 of the auxiliary propulsion device 30, and the rudder angle A2 of the auxiliary propulsion device 30 when both the main propulsion device 20 and the auxiliary propulsion device 30 are driven to move the hull 10 in the lateral direction in response to the operation on the joystick 43 to move the hull 10 in the lateral direction. Accordingly, the intersection 82 of the output vector V11 of the main propulsion device 20 and the output vector V21 of the auxiliary propulsion device 30 is adjusted according to the shape and size of the hull 10, the attachment positions of the main propulsion device 20 and the auxiliary propulsion device 30 to the hull 10, etc. to be positioned on the straight line 92 extending from the center of gravity 81 of the hull 10 toward one side in the lateral direction that is to be the moving direction of the hull 10. That is, regardless of the shape and size of the hull 10, the attachment positions of the main propulsion device 20 and the auxiliary propulsion device 30 to the hull 10, etc., the hull 10 is moved in the lateral direction without being rotated.

According to a preferred embodiment of the present invention, the controller 50 is configured or programmed to perform a control to move the hull 10 in the diagonal direction in addition to the control to move the hull 10 in the lateral direction by driving both the main propulsion device 20 and the auxiliary propulsion device 30. Accordingly, in a structure including the main propulsion device 20 and the auxiliary propulsion device 30 having different maximum outputs, the hull 10 is moved in the diagonal direction in addition to the lateral direction while an increase in the number of propulsion devices is prevented.

According to a preferred embodiment of the present invention, the controller 50 is configured or programmed to perform a control to move the hull 10 in the diagonal direction by positioning the intersection 83 of the output vector V12 of the main propulsion device 20 and the output vector V22 of the auxiliary propulsion device 30 on the straight line 93 extending from the center of gravity 81 of the hull 10 toward one side in the diagonal direction that is to be the moving direction of the hull 10. Accordingly, unlike a case in which the intersection 83 of the output vector V12 of the main propulsion device 20 and the output vector V22 of the auxiliary propulsion device 30 is deviated from the straight line 93 extending from the center of gravity 81 of the hull 10 toward one side in the diagonal direction that is to be the moving direction of the hull 10, a rotational moment is not generated in the hull 10, and thus the hull 10 is moved in the diagonal direction without being rotated.

According to a preferred embodiment of the present invention, the controller 50 is configured or programmed to perform a control to adjust, according to the hull 10, the output T1 of the main propulsion device 20, the rudder angle A1 of the main propulsion device 20, the output T2 of the auxiliary propulsion device 30, and the rudder angle A2 of the auxiliary propulsion device 30 when both the main propulsion device 20 and the auxiliary propulsion device 30 are driven to move the hull 10 in the diagonal direction in response to the operation on the joystick 43 to move the hull 10 in the diagonal direction. Accordingly, the intersection 83 of the output vector V12 of the main propulsion device 20 and the output vector V22 of the auxiliary propulsion device 30 is adjusted according to the shape and size of the hull 10, the attachment positions of the main propulsion device 20 and the auxiliary propulsion device 30 to the hull 10, etc. to be positioned on the straight line 93 extending from the center of gravity 81 of the hull 10 toward one side in the diagonal direction that is to be the moving direction of the hull 10. That is, regardless of the shape and size of the hull 10, the attachment positions of the main propulsion device 20 and the auxiliary propulsion device 30 to the hull 10, etc., the hull 10 is moved in the diagonal direction without being rotated.

According to a preferred embodiment of the present invention, the main propulsion device 20 includes the engine 22 having a maximum value and a minimum value of the power range larger than a maximum value and a minimum value in the power range of the electric motor 32 to drive the main propeller 21 (main thruster) that generates a thrust, and the controller 50 is configured or programmed to limit the power range T10 of the engine 22 by matching the upper limit value of the power range T10 of the engine 22 with the maximum value T21 of the power range T20 of the electric motor 32 while both the main propulsion device 20 and the auxiliary propulsion device 30 are driven to move the hull 10 in the lateral direction, and limit the power range T20 of the electric motor 32 by matching the lower limit value of the power range T20 of the electric motor 32 with the minimum value T12 of the power range T10 of the engine 22 while both the main propulsion device 20 and the auxiliary propulsion device 30 are driven to move the hull 10 in the lateral direction. Accordingly, the power range T10 of the engine 22 and the power range T20 of the electric motor 32 are limited within the same range while both the main propulsion device 20 and the auxiliary propulsion device 30 are driven to move the hull 10 in the lateral direction, and thus when the hull 10 is moved in the lateral direction, both the main propulsion device 20 and the auxiliary propulsion device 30 having different maximum outputs are easily driven.

According to a preferred embodiment of the present invention, the controller 50 is configured or programmed to cause the direction of the output vector V11 of the main propulsion device 20 and the direction of the output vector V21 of the auxiliary propulsion device 30 to be opposite to each other in the forward-rearward direction when the hull 10 is moved in the lateral direction. Accordingly, the forward-rearward component of the output vector V11 of the main propulsion device 20 and the forward-rearward component of the output vector V21 of the auxiliary propulsion device 30 cancel each other out, and thus the direction of the resultant vector V31 of the output vector V11 of the main propulsion device 20 and the output vector V21 of the auxiliary propulsion device 30 is set to be a lateral direction such that the hull 10 is moved in the lateral direction.

According to a preferred embodiment of the present invention, the controller 50 is configured or programmed to perform a control to move the hull 10 in the lateral direction by driving both the main propulsion device 20 and the auxiliary propulsion device 30 when the joystick 43 corresponding to the operator to operate the hull 10 is tilted in the lateral direction. Accordingly, the direction (lateral direction) of an operation on the joystick 43 (operator) and the direction (lateral direction) in which the hull 10 is moved are the same as each other, and thus an operation on the joystick 43 (operator) to move the hull 10 in the lateral direction is performed in an intuitively easy-to-understand state.

According to a preferred embodiment of the present invention, the main propulsion device 20 is an engine outboard motor including the engine 22 to drive the main propeller 21 corresponding to the main thruster that generates a thrust and provided on the centerline 91 of the hull 10 in the right-left direction, and the auxiliary propulsion device 30 is an electric outboard motor including the electric motor 32 to drive the auxiliary propeller 31 corresponding to the auxiliary thruster and provided to one side of the centerline of the hull 10 in the right-left direction. The maximum value T11 of the power range T10 of the engine 22 is larger than the maximum value T21 of the power range T20 of the electric motor 32. Therefore, as described above, the main propulsion device 20 and the auxiliary propulsion device 30 are an engine outboard motor and an electric outboard motor, respectively, such that the maximum output of the auxiliary propulsion device 30 is smaller than the maximum output of the main propulsion device 20, and thus a structure in which both the main propulsion device 20 and the auxiliary propulsion device 30 having a maximum output smaller than a maximum output of the main propulsion device 20 are driven is easily achieved.

The preferred embodiments of the present invention described above are illustrative in all points and not restrictive. The extent of the present invention is not defined by the above description of the preferred embodiments but by the scope of the claims, and all modifications within the meaning and range equivalent to the scope of the claims are further included.

For example, while the main propulsion device 20 is preferably an engine outboard motor including the engine 22 to drive the main propeller 21 corresponding to a main thruster that generates a thrust, and the auxiliary propulsion device 30 is preferably an electric outboard motor including the electric motor 32 to drive the auxiliary propeller 31 corresponding to an auxiliary thruster in preferred embodiments described above, the present invention is not restricted to this. In the present invention, the main propulsion device may alternatively be an electric outboard motor including an electric motor to drive the main propeller corresponding to a main thruster. Furthermore, the main propulsion device and the auxiliary propulsion device may alternatively be inboard motors enclosed within the hull instead of outboard motors, or inboard-outboard motors partially enclosed within the hull.

While the controller 50 preferably performs a control to move the hull 10 in the diagonal direction by driving both the main propulsion device 20 and the auxiliary propulsion device 30 when the joystick 43 corresponding to an operator to operate the hull 10 is tilted in the diagonal direction in preferred embodiments described above, the present invention is not restricted to this. In the present invention, the controller may alternatively perform a control to move the hull in the diagonal direction by driving both the main propulsion device and the auxiliary propulsion device when an operation is performed on an operator other than the joystick to move the hull in the diagonal direction.

While the controller 50 preferably performs a control to move the hull 10 in the lateral direction by driving both the main propulsion device 20 and the auxiliary propulsion device 30 when the joystick 43 corresponding to an operator to operate the hull 10 is tilted in the lateral direction in preferred embodiments described above, the present invention is not restricted to this. In the present invention, the controller may alternatively perform a control to move the hull in the lateral direction by driving both the main propulsion device and the auxiliary propulsion device when an operation is performed on an operator other than the joystick to move the hull in the lateral direction.

While the controller 50 preferably performs a control to adjust, according to the hull 10, the output T1 of the main propulsion device 20, the rudder angle A1 of the main propulsion device 20, the output T2 of the auxiliary propulsion device 30, and the rudder angle A2 of the auxiliary propulsion device 30 when both the main propulsion device 20 and the auxiliary propulsion device 30 are driven to move the hull 10 in the diagonal direction in response to the operation on the joystick 43 (operator) to move the hull 10 in the diagonal direction in preferred embodiments described above, the present invention is not restricted to this. In the present invention, the controller 50 may not perform a control to adjust, according to the hull, the output of the main propulsion device, the rudder angle of the main propulsion device, the output of the auxiliary propulsion device, and the rudder angle of the auxiliary propulsion device when both the main propulsion device and the auxiliary propulsion device are driven to move the hull in the diagonal direction in response to the operation on the operator to move the hull in the diagonal direction. In such a case, the output of the main propulsion device, the rudder angle of the main propulsion device, the output of the auxiliary propulsion device, and the rudder angle of the auxiliary propulsion device may be manually set by the vessel operator when both the main propulsion device and the auxiliary propulsion device are driven to move the hull in the diagonal direction, for example.

While the controller 50 preferably performs a control to move the hull 10 in the diagonal direction in addition to the control to move the hull 10 in the lateral direction by driving both the main propulsion device 20 and the auxiliary propulsion device 30 in preferred embodiments described above, the present invention is not restricted to this. In the present invention, the controller may not perform a control to move the hull in the diagonal direction by driving both the main propulsion device and the auxiliary propulsion device.

While the controller 50 preferably performs a control to adjust, according to at least one of a shape of the hull 10, a size of the hull 10, and attachment positions of the main propulsion device 20 and the auxiliary propulsion device 30 to the hull 10, the output T1 of the main propulsion device 20, the rudder angle A1 of the main propulsion device 20, the output T2 of the auxiliary propulsion device 30, and the rudder angle A2 of the auxiliary propulsion device 30 when both the main propulsion device 20 and the auxiliary propulsion device 30 are driven to move the hull 10 in the lateral direction in response to the operation on the joystick 43 (operator) to move the hull 10 in the lateral direction in preferred embodiments described above, the present invention is not restricted to this. In the present invention, the controller may not perform a control to adjust, according to at least one of a shape of the hull, a size of the hull, and attachment positions of the main propulsion device and the auxiliary propulsion device to the hull the output of the main propulsion device, the rudder angle of the main propulsion device, the output of the auxiliary propulsion device, and the rudder angle of the auxiliary propulsion device when both the main propulsion device and the auxiliary propulsion device are driven to move the hull in the lateral direction in response to the operation on the operator to move the hull in the lateral direction. In such a case, the output of the main propulsion device, the rudder angle of the main propulsion device, the output of the auxiliary propulsion device, and the rudder angle of the auxiliary propulsion device may be manually set by the vessel operator when both the main propulsion device and the auxiliary propulsion device are driven to move the hull in the lateral direction, for example.

While the auxiliary propulsion device 30 is preferably provided to the L side (left side) of the centerline of the hull 10 in preferred embodiments described above, the present invention is not restricted to this. In the present invention, the auxiliary propulsion device may alternatively be provided to the right side of the centerline of the hull.

While the main propulsion device 20 is preferably provided on the centerline 91 of the hull 10 in the right-left direction, and the auxiliary propulsion device 30 is preferably provided to one side of the hull 10 in the right-left direction in preferred embodiments described above, the present invention is not restricted to this. In the present invention, the main propulsion device may alternatively be provided to one side of the hull in the right-left direction, or the auxiliary propulsion device may alternatively be provided on the centerline of the hull in the right-left direction.

While only one main propulsion device 20 is preferably attached to the stern 11 of the hull 10 in preferred embodiments described above, the present invention is not restricted to this. In the present invention, two or more main propulsion devices may alternatively be attached to the stern of the hull.

While only one auxiliary propulsion device 30 is preferably attached to the stern 11 of the hull 10 in preferred embodiments described above, the present invention is not restricted to this. In the present invention, two or more auxiliary propulsion devices may alternatively be attached to the stern of the hull.

While the main propulsion device 20 is preferably steerable by about 30 degrees to each of the L side (the left side of the hull) and the R side (the right side of the hull) in preferred embodiments described above, the present invention is not restricted to this. In the present invention, the main propulsion device may alternatively be steerable by an angle other than about 30 degrees to each of the left and right sides of the hull.

While the auxiliary propulsion device 30 is preferably steerable by about 70 degrees to each of the L side (the left side of the hull) and the R side (the right side of the hull) in preferred embodiments described above, the present invention is not restricted to this. In the present invention, the auxiliary propulsion device may alternatively be steerable by an angle other than about 70 degrees to each of the left and right sides of the hull.

While preferred embodiments of the present invention have been described above, variations and modifications will be apparent to those skilled in the art without departing from the scope and spirit of the present invention. The scope of the present invention, therefore, is to be determined solely by the following claims.

What is claimed is:

1. A marine propulsion system comprising:

a main propulsion device attached to a stern of a hull and operable to rotate in a right-left direction about a first steering shaft located a first distance rearward of the stern to change a direction of a thrust;

an auxiliary propulsion device attached to the stern, including an electric motor to drive an auxiliary thruster to generate a thrust, operable to rotate in the right-left direction about a second steering shaft located a second distance rearward of the stern greater than the first distance to change a direction of the thrust, and having a maximum output smaller than a maximum output of the main propulsion device; and a controller configured or programmed to perform a control to move the hull in a lateral direction by driving both the main propulsion device and the auxiliary propulsion device; wherein the main propulsion device is provided on a centerline of the hull in the right-left direction; and the auxiliary propulsion device is provided to one side of the centerline of the hull in the right-left direction.

2. The marine propulsion system according to claim 1, wherein the controller is configured or programmed to perform a control to move the hull in the lateral direction by positioning an intersection of an output vector of the main propulsion device and an output vector of the auxiliary propulsion device on a straight line extending from a center of gravity of the hull toward a side in the lateral direction in which the hull is to move.

3. The marine propulsion system according to claim 1, wherein the controller is configured or programmed to perform a control to move the hull in a diagonal direction in addition to the control to move the hull in the lateral direction by driving both the main propulsion device and the auxiliary propulsion device.

4. The marine propulsion system according to claim 3, wherein the controller is configured or programmed to perform a control to move the hull in the diagonal direction by positioning an intersection of an output vector of the main propulsion device and an output vector of the auxiliary propulsion device on a straight line extending from a center of gravity of the hull toward a side in the diagonal direction in which the hull is to move.

5. The marine propulsion system according to claim 4, wherein the controller is configured or programmed to perform a control to adjust, according to at least one of a shape of the hull, a size of the hull, and attachment positions of the main propulsion device and the auxiliary propulsion device to the hull, an output of the main propulsion device, a rudder angle of the main propulsion device, an output of the auxiliary propulsion device, and a rudder angle of the auxiliary propulsion device when both the main propulsion device and the auxiliary propulsion device are driven to move the hull in the diagonal direction in response to an operation on an operator to move the hull in the diagonal direction.

6. The marine propulsion system according to claim 1, wherein the main propulsion device includes an engine having a maximum value and a minimum value of a power range larger than a maximum value and a minimum value of a power range of the electric motor to drive a main thruster that generates the thrust; and the controller is configured or programmed to:

limit the power range of the engine by matching an upper limit value of the power range of the engine with the maximum value of the power range of the electric motor while both the main propulsion device and the auxiliary propulsion device are driven to move the hull in the lateral direction; and limit the power range of the electric motor by matching a lower limit value of the power range of the electric motor with the minimum value of the power range of the engine while both the main propulsion device and the auxiliary propulsion device are driven to move the hull in the lateral direction.

7. The marine propulsion system according to claim 1, wherein the controller is configured or programmed to cause a direction of an output vector of the main propulsion device and a direction of an output vector of the auxiliary propulsion device to be opposite to each other in a forward-rearward direction when the hull is moved in the lateral direction.

8. The marine propulsion system according to claim 1, wherein the controller is configured or programmed to perform a control to move the hull in the lateral direction by driving both the main propulsion device and the auxiliary propulsion device when a joystick corresponding to an operator to operate the hull is tilted in the lateral direction.

9. The marine propulsion system according to claim 1, wherein the main propulsion device is an engine outboard motor including an engine to drive a main propeller corresponding to a main thruster that generates the thrust; and the auxiliary propulsion device is an electric outboard motor including the electric motor to drive an auxiliary propeller corresponding to the auxiliary thruster.

10. A marine propulsion system comprising:

a main propulsion device attached to a stern of a hull and operable to rotate in a right-left direction about a first steering shaft located a first distance rearward of the stern to change a direction of a thrust;

an auxiliary propulsion device attached to the stern, operable to rotate in the right-left direction about a second steering shaft located a second distance rearward of the stern greater than the first distance to change a direction of a thrust, and having a maximum output smaller than a maximum output of the main propulsion device; and a controller configured or programmed to perform a control to move the hull in a lateral direction by driving both the main propulsion device and the auxiliary propulsion device; wherein the main propulsion device is provided on a centerline of the hull in the right-left direction; and the auxiliary propulsion device is provided to one side of the centerline of the hull in the right-left direction.

11. A marine vessel comprising:

a hull; and a marine propulsion system provided on or in the hull; wherein the marine propulsion system includes:

a main propulsion device attached to a stern of the hull and operable to rotate in a right-left direction about a first steering shaft located a first distance rearward of the stern to change a direction of a thrust;

an auxiliary propulsion device attached to the stern, including an electric motor to drive an auxiliary thruster that generates a thrust, operable to rotate in the right-left direction about a second steering shaft located a second distance rearward of the stern greater than the first distance to change a direction of the thrust, and having a maximum output smaller than a maximum output of the main propulsion device; and a controller configured or programmed to perform a control to move the hull in a lateral direction by driving both the main propulsion device and the auxiliary propulsion device; wherein the main propulsion device is provided on a centerline of the hull in the right-left direction; and the auxiliary propulsion device is provided to one side of the centerline of the hull in the right-left direction.

12. The marine vessel according to claim 11, wherein the controller is configured or programmed to perform a control to move the hull in the lateral direction by positioning an intersection of an output vector of the main propulsion device and an output vector of the auxiliary propulsion device on a straight line extending from a center of gravity of the hull toward a side in the lateral direction in which the hull is to move.

13. The marine vessel according to claim 11, wherein the controller is configured or programmed to perform a control to move the hull in a diagonal direction in addition to the control to move the hull in the lateral direction by driving both the main propulsion device and the auxiliary propulsion device.

14. The marine vessel according to claim 13, wherein the controller is configured or programmed to perform a control to move the hull in the diagonal direction by positioning an intersection of an output vector of the main propulsion device and an output vector of the auxiliary propulsion device on a straight line extending from a center of gravity of the hull toward a side in the diagonal direction in which the hull is to move.

15. The marine vessel according to claim 14, wherein the controller is configured or programmed to perform a control to adjust, according to at least one of a shape of the hull, a size of the hull, and attachment positions of the main propulsion device and the auxiliary propulsion device to the hull, an output of the main propulsion device, a rudder angle of the main propulsion device, an output of the auxiliary propulsion device, and a rudder angle of the auxiliary propulsion device when both the main propulsion device and the auxiliary propulsion device are driven to move the hull in the diagonal direction in response to an operation on an operator to move the hull in the diagonal direction.

16. The marine vessel according to claim 11, wherein the main propulsion device includes an engine having a maximum value and a minimum value of a power range larger than a maximum value and a minimum value of a power range of the electric motor to drive a main thruster that generates the thrust; and the controller is configured or programmed to:

limit the power range of the engine by matching an upper limit value of the power range of the engine with the maximum value of the power range of the electric motor while both the main propulsion device and the auxiliary propulsion device are driven to move the hull in the lateral direction; and limit the power range of the electric motor by matching a lower limit value of the power range of the electric motor with the minimum value of the power range of the engine while both the main propulsion device and the auxiliary propulsion device are driven to move the hull in the lateral direction.

* * * * *